United States Patent [19]

Rainer et al.

[11] 4,366,823

[45] Jan. 4, 1983

[54] PROCESS FOR EXPANDING TOBACCO

[75] Inventors: Norman B. Rainer; Dean M. Siwiec, both of Richmond, Va.

[73] Assignee: Philip Morris, Incorporated, New York, N.Y.

[21] Appl. No.: 277,315

[22] Filed: Jun. 25, 1981

[51] Int. Cl.[3] ..... A24B 3/18

[52] U.S. Cl. ..... 131/291; 131/903; 131/352; 131/301

[58] Field of Search ..... 131/291, 293, 296, 292, 131/294, 295, 309, 310, 903, 352, 300, 301, 302

[56] References Cited

U.S. PATENT DOCUMENTS

| | | |
|---|---|---|
| 757,514 | 4/1904 | Thoms . |
| 2,029,494 | 2/1933 | Loewenthal . |
| 2,341,535 | 3/1940 | Elliott . |
| 2,429,567 | 12/1941 | Sowa . |
| 2,598,680 | 6/1947 | Frankenburg . |
| 2,914,072 | 1/1955 | Tyrer . |
| 3,409,022 | 12/1965 | Burde . |
| 3,409,023 | 12/1965 | Burde . |
| 3,409,027 | 12/1965 | Burde . |
| 3,409,028 | 12/1965 | Burde . |
| 3,425,425 | 1/1967 | Hind . |
| 3,612,065 | 3/1970 | Rosen . |
| 3,734,104 | 11/1971 | Buchanan . |
| 3,851,653 | 10/1972 | Rosen . |
| 3,889,689 | 8/1972 | Rosen . |
| 3,943,945 | 9/1972 | Rosen . |
| 4,013,082 | 2/1975 | Rosen . |

OTHER PUBLICATIONS

CA 88: 71744y, Reducing the percentage of undesirable substances in plants for human use, such as tobacco, Sneider, Enrico.

CA 85: 75205j, Reduction of the concentration of undesirable substances in plants destined for human use, Lenzi e C. Di Enrico.

CA 80: 45796g, Improvement of tobacco quality, Manole, Gh Constantinescu.

CA 72: 51949k, Effect of Hydrogen peroxide on selected qualities of flu-cured tobacco, Chakraborty, M. K.

CA 80: 130648e, Effect of hydrogen peroxide on physicochemical characteristics of natu tobacco, Chakraborty, M. K.

CA 65: 5891a, Treatment of tobacco, Philip Morris, Neth. Appl. 6,511,755.

*Primary Examiner*—V. Millin

*Attorney, Agent, or Firm*—Arthur I. Palmer, Jr.

[57] ABSTRACT

An improved process for expanding tobacco wherein tobacco components such as stems, midribs and veins are contacted with an alkaline-hydrogen peroxide solution to effect expansion, washed and then dried and/or roasted to produce an expanded tobacco material highly suitable for use in smoking products. Prior to contact with the alkaline hydrogen peroxide solution, the tobacco materials are subjected to a pretreatment step with a multivalent salt solution to prevent clumping and/or interadherence of the tobacco shreds which would otherwise occur during the drying step.

23 Claims, No Drawings

PROCESS FOR EXPANDING TOBACCO

FIELD OF THE INVENTION

The present invention relates to an improved process for expanding tobacco. More particularly the invention provides a process wherein tobacco components such as stems, midribs and veins are contacted with an alkaline-hydrogen peroxide solution to effect expansion, washed and then dried and/or roasted to produce an expanded tobacco material highly suitable for use in smoking products. Prior to contact with the alkaline hydrogen peroxide solution, the tobacco materials are subjected to a pretreatment step to prevent clumping and/or interadherence of the tobacco shreds which would otherwise occur during the drying step. Said pretreatment step may include exposure to gaseous ozone or impregnation with a divalent material salt or an aluminate salt.

DESCRIPTION OF THE PRIOR ART

The use of hydrogen peroxide in tobacco processing has been suggested for various purposes. Hydrogen peroxide has been employed to bleach dark fermented tobacco leaf to obtain a more desirable golden color. In U.S. Pat. No. 2,341,535, tobacco leaf is treated with an ammoniacal solution of hydrogen peroxide to improve color and taste. The treatment involves the application of hydrogen peroxide solutions of at least 11 percent concentration in amounts such that the total water content is between 21 and 35 pounds per 100 pounds of tobacco. The treated tobacco leaf is then stored in a loose pile for 16 to 24 hours at temperatures ranging as high as 120° F. Subsequently the tobacco is heated to remove excess hydrogen peroxide. There is no mention of increased filling power.

In some instances, oxidizing agents such as hydrogen peroxide or ozone have been suggested for use in reducing certain constituents in tobacco. In Chemical Abstracts (hereinafter CA) 85:75205, plants such as tobacco are treated with an oxidizing agent followed by treatment with ammonia or other alkaline materials. Steam distillation subsequently serves to remove alkaloids such as nicotine. In CA 80:45796g, fermented tobacco is improved by treatment with hydrogen peroxide and heat. Such treatment apparently results in partial oxidation of the cellulose and nicotine present.

In CA 72:51949k, there is described the treatment of tobacco leaf with hydrogen peroxide at a concentration of 7% for 25 hours at 40°, which treatment is said to increase the sugar/nicotine ratio, filling power and total volatile acids and decrease the total carbonyl content. CA 80:130648c describes a similar type treatment of tobacco leaf with 32% hydrogen peroxide at 45°, which treatment apparently resulted in increased filling power of the leaf by 15 to 20% and lowered nicotine content by 33.2% when compared with untreated leaf. In each instance the processes appear to be limited to the treatment or modification of tobacco leaf.

U.S. Pat. Nos. 3,612,065; 3,889,689; 3,943,945 and 4,013,082 to Rosen describe methods for expanding tobacco wherein the tobacco is treated with an enzyme solution of catalase followed by the addition of a solution of hydrogen peroxide solution. According to the inventor, excessive amounts of hydrogen peroxide are to be avoided, otherwise undesirable oxidation of the tobacco occurs. Generally, the concentration of hydrogen peroxide employed should be in the range of 10 to 50 volumes, and preferably 20 to 40 volumes, according to the inventor. The enzyme catalase catalyzes the decomposition of hydrogen peroxide to yield water and oxygen gas. The oxygen gas serves to expand the tobacco.

The '689 patent relates to the use of physical force, such as rollers and the like, to effect better impregnation of the catalase and hydrogen peroxide solutions into the tobacco. The '945 patent describes methods for expanding reconstituted tobacco using hydrogen peroxide and catalase while the '082 patent describes the use of negative pressure to cause oxygen gas resulting from the reaction of catalase and hydrogen peroxide to form large bubbles in the tobacco cell interstices thereby effecting greater expansion of the tobacco.

An additional patent to Rosen, U.S. Pat. No. 3,851,653, describes a process wherein tobacco lamina is first treated with sufficient hydrogen peroxide at 70° to 140° F. to oxidize the nicotine and tars contained therein followed by sufficient catalase to decompose the hydrogen peroxide remaining in the tobacco. Puffing occurs prior to drying. After conventional drying, the filling capacity is said to have increased by 40.4%.

Techniques proposed especially for the expansion of tobacco stems include U.S. Pat. No. 3,409,022 wherein tobacco stems having a moisture content in the range of 4 to 23% by weight are exposed to a source of radiant energy at sub-atmospheric pressure to effect expansion thereof.

Other patents related to expansion of tobacco stems wherein heat treatment or microwave energy are employed include U.S. Pat. Nos. 3,409,023; 3,409,027 and 3,409,028. U.S. Pat. No. 3,734,104 also relates to a process for the expansion of tobacco stems.

U.S. Pat. No. 3,425,425 describes the treatment of tobacco stems with an aqueous carbohydrate solution comprising in addition from 0 to 200 parts by weight of a compound selected from citric acid, malic acid, phosphoric acid, monobasic potassium phosphate, ammonium hydroxide, calcium chloride, potassium hydroxide, potassium nitrate, potassium acid phosphate, sodium chloride and mixtures thereof. Following a suitable impregnation period, the stems are exposed to a source of heat to effect expansion. In some instances, the stems may be water extracted prior to treatment with the carbohydrate solution.

Various divalent salts have been proposed as additives for tobacco products. For example, CA 65:5891a (Netherlands Application No. 6,511,755 published Mar. 15, 1966) discloses the addition of alkali metal and/or alkaline earth metal salts to tobacco or filters to improve smoking characteristics. Particularly preferred are the salts of weak acids such as, for example, the alkali metal carbonates, bicarbonates and bisulfites. Sodium, potassium, lithium, barium and calcium salts are specified by the inventor. Generally the final product should contain between 0.1 and 0.5% of the salt by weight of the tobacco.

Multivalent salts in minute quantities have been suggested for incorporation in reconstituted tobacco. See, for example, U.S. Pat. No. 2,598,608.

U.S. Pat. No. 2,914,072 describes the use of metallic and organic salts in combination, as catalysts, to promote greater combustion and thermal destruction of the undesirable alkaline, especially nicotine-base alkaline, by-products found in the smoke. U.S. Pat. No. 2,429,567 describes a method of reducing the nicotine content of tobacco by means of salt additives, especially chloride salts, which bind with the nicotine released upon burning.

Other workers have proposed the use of multivalent metals or acids by one means or another to improve the flavor of the tobacco by binding acids and/or bases of the smoke of combustion. See, for example, U.S. Pat. Nos. 757,514 and 2,029,494.

In co-pending, commonly assigned application Ser. No. 938,118 filed Aug. 30, 1978, there is described a method for increasing the filling power of a blended tobacco filler material by applying to the tobacco a solution of a multivalent salt to a level of about 0.2 to 7.5% by dry weight of the tobacco. The salts of the multivalent metals found to be effective in cross-linking pectinaceous materials include the salts of the alkaline earth metals, metals of the periodic table transition series and combinations of these with the alkali metals including, for example, aluminum, calcium, magnesium, titanium, zinc, chromium, manganese, molybdenum, nickel, tin and iron.

The acids of said salts which have been found to be effective include malonic, malic, tartaric, adipic, lactic, glycolic, fumaric, ascorbic, aspartic, glutamic, sulfamic, formic, gallic, phosphoric, citric, oxalic, succinic and tannic. Through interaction with the pectinaceous materials of the tobacco filler, the aforesaid additive salt solutions cause, upon drying, the retention of the expanded form of the tobacco by stiffening and firmly binding the expanded pectinaceous fibers of the tobacco. Although expansion in the range of 5 to 25% is observed in said co-pending application, the process of the present invention results in substantially greater expansion thereby resulting in a more economical product for use in smoking articles.

While all of the above discussed expansion processes result in an increase in filling capacity of tobacco and, in some instances, tobacco stems, none have been found entirely suitable for expansion of tobacco stems when alkaline hydrogen peroxide is employed as the expansion agent. We have observed that when tobacco stems are treated with an alkaline solution of hydrogen peroxide and then dried, interadherence and clumping of the stem shreds may occur, thereby rendering the tobacco unsuitable for use in conventional smoking products. This phenomena is particularly evident if the stems are subjected to a water extraction or aqueous soaking at some point during processing and are then dried under static conditions permitting intershred contact. However, we have found that certain pretreatment of the shredded stems prior to alkaline hydrogen peroxide treatment prevents formation of clumps due to the interadherence of the shreds during drying, thereby resulting in a useful product which, due to its greatly increased filling power, is highly desirable for use in smoking products and particularly low delivery products.

SUMMARY OF THE INVENTION

The present invention relates to an improved process for the treatment of tobacco stems whereby the filling capacity of the stems is substantially increased and the density reduced as compared to ordinary cut tobacco stems normally used in filler.

The process involves the steps of (1) pretreating whole or rolled and cut tobacco stems with a polyvalent metal salt solution to prevent interadherence or clumping thereof, (2) contacting the pretreated stems in shredded form with an alkaline-hydrogen peroxide solution at a temperature below about 55° C. for a period of time between 5 to 120 minutes to effect expansion thereof, (3) extracting the expanded stems with water, and (4) drying or roasting the expanded and extracted stem material. The aqueous extract from Step (3) may be processed to remove therefrom excess pretreatment additives from step (1) and/or salts such as potassium nitrate naturally occurring in the stems. The processed aqueous extract may then be returned to the expanded stems prior to drying.

The pretreatment step may consist of exposing the tobacco stems to gaseous ozone prior to contact with the alkaline hydrogen peroxide. Alternatively, the pretreatment step consists of impregnating tobacco stems with a concentrated solution of a polyvalent metal salt prior to contacting with the alkaline-hydrogen peroxide solution. The tobacco stems thus treated have a substantially increased filling capacity and are highly suitable for incorporation into tobacco blends ultimately used in smoking products.

DESCRIPTION OF THE PREFERRED EMBODIMENTS

In accordance with the present invention, tobacco stems, and particularly bright or burley tobacco stems, are expanded using alkaline-hydrogen peroxide. Pretreatment of the stems is necessary so as to prevent interadherence or clumping of the stems upon drying following treatment with the alkaline hydrogen peroxide solution.

The tobacco stems will generally be moistened and then rolled or crushed according to known methods. It may be preferable to also cut the stems to filler size by conventional methods, namely, to 75 to 200 cuts per inch or smaller prior to expansion.

Specific pretreating agents for stem material have been found to prevent interadherence and clumping of the expanded stem product. Namely, the stems may be treated with gaseous ozone and immediately thereafter treated with alkaline hydrogen peroxide to effect expansion. Alternatively, pretreatment with a polyvalent metal salt has also been found satisfactory in preventing clumping. An additional pretreatment method found suitable includes the use of an aluminate salt. Each of the instant methods will be discussed hereinbelow.

In accordance with a preferred embodiment of the invention, tobacco stems, having a moisture content in the range of 20 to 50% moisture, and preferably about 30 to 35% moisture, are treated with a gas stream containing 5 to 10% ozone for approximately 5 to 10 minutes at ambient temperature and pressure. Ideally, the tobacco is contacted with gaseous ozone in an enclosed system into which the ozone is sparged for the aforementioned period of time. For example, shredded stems may be conveyed on a screen belt in an enclosed "tunnel" or ozone chamber whereby the stems are impregnated with sufficient ozone to prevent interadherence or clumping during subsequent processing. Immediately upon emerging from the tunnel or ozone chamber the stems are contacted with an alkaline hydrogen peroxide solution.

Contact with the alkaline hydrogen peroxide solution may be accomplished by spraying or dipping the stems. The total amount of solution employed to treat the stems will range from a 65% weight add-on to amounts wherein the stems merely represent a small weight fraction of a mixture wherein the peroxide solution is recirculated for treatment of successive batches of stem material.

The "percent add-on" as used herein is defined as follows:

$$\% \text{ add-on} = \frac{\text{weight of solution} \times 100}{\text{dry weight on tobacco} + \text{weight of solution}}$$

It has been found that unless the percent add-on exceeds about 65%, little if any expansion occurs for reasons to be discussed hereinbelow. The alkaline hydrogen peroxide solution employed is made alkaline by the addition of an acceptable base such as potassium hydroxide, ammonium hydroxide, calcium hydroxide, sodium hydroxide, sodium and potassium carbonates, and the like, said base being present at a concentration of about 2 to 20% depending on the strength of base used. The concentration of hydrogen peroxide will vary to some extent depending on the type of tobacco material being treated but will, in any event, be in the range of about 3 to 25%, and preferably between about 5 and 15%, based on the weight of the solution. The pH of the solution will generally be from about 8 to 10 depending on the concentration of the base. While shortened periods of contact result in some expansion, it is preferable to permit the alkaline hydrogen peroxide solution sufficient time to enter the tobacco material and interact therewith. For instance, contact times of from about 5 to 90 minutes are generally sufficient to achieve satisfactory results. During this time interval, excess solution may be recirculated and reapplied to the tobacco to insure complete impregnation and efficient utilization of the peroxide solution. The temperature during impregnation is typically maintained at about 25° to 55° C. When spraying techniques are used, and it is sought to avoid excess solution which would result in run-off, a maximum add-on of 85% is appropriate.

Following contact with the alkaline hydrogen peroxide solution, the tobacco stems are washed by known methods such as soaking, dipping, spraying, counter current extraction, and the like to remove excess alkaline-hydrogen peroxide. In the event that pre-extracted stems are utilized, it may be desirable to reapply the tobacco solubles removed during water extraction. In this instance, the solubles may be treated to remove various constituents such as nitrate salts. Techniques known in the art such as ion exchange, ion retardation, crystallization, microbial fermentation or electrodialysis may be employed to effect removal of nitrate salts. Thereafter, the solubles are restored to the peroxide-treated, washed tobacco stems using conventional methods. Flavorants, burn control additives, humectants and the like may also be applied, and the tobacco stem material is then dried to the desired moisture content, generally in the range of about 10 to 15% on a dry weight basis.

While any conventional type of tobacco drying apparatus may be used to dry the tobacco, suitable results are obtained by static or fluidized bed drying at temperatures between about 50° and 200° C. in an air convection oven or heating tunnels associated with conveyor belts. Drying at room temperature overnight or, alternatively, freeze drying the stems results in a highly expanded product. Further drying techniques may involve exposure to infra-red or microwave sources or a high velocity heated gas utilized in a tower or column which transports the tobacco during the drying process.

While the above-described process is particularly suitable for treatment of tobacco stems, midribs or veins shredded to filler size, we have found that the process may also be employed to effect an improvement in the filling power of reconstituted tobacco. In this instance, a blend of tobacco stems, fines and the like is extracted with water and the aqueous portion is separated from the fibrous tobacco portion. Thereafter the fibrous portion is pulped and cast on a Fourdrinier belt thereby forming a base web. The base web is adjusted to a moisture content of about 20 to 50%, shredded to filler size and treated with gaseous ozone as described hereinabove with the exception that the wash step following alkaline hydrogen peroxide is omitted. Preferably ammonium hydroxide is employed since excess base can be removed during subsequent drying. Thereafter the solubles removed in the extraction step are reapplied to the shredded, expanded base web. In addition, other additives conventionally used in tobacco reconstitution processes may be applied. Reconstituted tobaccos treated in accordance with the present invention will generally have an increased filling capacity of 15% or greater as compared to untreated reconstituted tobacco.

In an alternate approach, tobacco stems having a moisture content of about 2 to 40% are contacted with an aqueous solution of a polyvalent salt. The stems, which may optionally be pre-extracted with water and shredded to filler size, are soaked or dipped in a solution of the polyvalent salt or alternatively, the salt solution may be applied to the stems by spraying. The polyvalent metal salts suitable for use in the present invention include the chloride, acetate or nitrate salts of metals such as calcium, magnesium, zinc and aluminum. Particularly effective are the magnesium salts of the above-noted anions. Typically, the concentration of the salt solution will be in the range of 5 to 20%, and preferably about 10%.

Application of the salt solution to the stems may be carried out in any type of vessel in which an even distribution of the salt solution into the tobacco is obtained. In certain instances, recirculation of the salt solution may be employed to insure optimum impregnation of the stems. Vacuum means may also be employed to force the solution into the tobacco matrix; however, this is not generally necessary. Contact times of approximately 5 minutes to 3 hours provide satisfactory results.

Following salt impregnation, the excess solution, if any, is removed from the stems by draining, centrifuging, pressing and the like, and the stems may then be partially dried to a moisture content of about 10 to 40% OV. Typically, static drying in an open air oven at about 75° to 100° C. for a period of time sufficient to obtain the desired moisture content has been found suitable. Thereafter the partially dried stems are contacted with the above-described alkaline-hydrogen peroxide solution in substantially the same manner as in the previously described embodiment wherein the stems are intially treated with ozone. It should be noted, however, that a higher concentration of base is generally required depending on the acidity of the polyvalent salt employed during pretreatment. For example, base concentrations between about 2 to 20% have been found satisfactory. Likewise, the subsequent washing and drying steps are essentially the same as in the earlier described embodiment.

Recirculation of the hydrogen peroxide is desirable to permit total impregnation of the stem material since once the stems are contacted with the peroxide solution, they expand and may rise above the treating solution, carrying just a limited amount of solution for completion of the reaction. Optionally, the stems may be subjected to a roasting operation at 175° to about 300° C. for a period of about 5 to 50 minutes to achieve a rich brown tobacco-like color. A weight loss of material in the range of 5 to 15% will generally occur during roasting depending on the temperature and length of time employed. To further alleviate the problem of intershed adherence upon drying, propylene glycol may be added to the washed stems at a level of 10 to 20% by weight of the stems prior to drying. Upon roasting within the previously designated temperature range, the propylene glycol evaporates and may be recovered and recycled. When the average shred size of the expanded tobacco is too large for blending with cut tobacco filler, the product may be subjected to a minimal reshredding or blended with strip tobacco prior to cutting.

The expanded tobacco prepared according to the processes described hereinabove may be blended with conventional tobacco filler at levels ranging from about 1 to about 50% by weight of the total filler. Thereafter the filler is incorporated into smoking articles such as cigarettes, cigars, cigarillos and the like, or may be used in pipe tobaccos.

As used throughout the specification, the term "cylinder volume" means a unit for measuring the filling power of tobacco. The term "oven-volatiles content" or "oven volatiles" is a unit for measuring moisture content (or percentage of moisture) in tobacco. As used throughout this application, the values employed, in connection with these terms, are determined as follows:

Cylinder Volume (CV)—Tobacco filler weighing 10.000 g is placed is a 3.358-cm diameter cylinder and compressed by a 1875-g piston 3.335 cm in diameter for 5 minutes. The resulting volume of filler is reported as cylinder volume and expressed as cc per 10 grams. This test is carried out at standard environmental conditions of 23.9° C. and 60% relative humidity (RH); conventionally unless otherwise stated, the sample is preconditioned in this environment for 18 hours.

Oven-Volatiles Content (OV)—The sample of tobacco filler is weighed before and after exposure for 3 hours in a circulating air oven controlled at 100° C. The weight loss as percentage of initial weight is oven-volatiles content.

Resistance to Draw (RTD) is defined as the pressure developed by the full length of a cigarette when air is pulled through it at the rate of 17.5 ml/second (20° C., 760 torr.); this value is expressed as inches of water.

Total Particulate Matter (TPM) is that portion of smoke which is collected on a Cambridge filter pad during automatic or mechanical smoking.

The present invention is based in part upon the observation that the internal volume of cured tobacco stem materials resides almost exclusively in open cells deriving from its botanical origin. By way of comparison, the internal volume of cured tobacco leaf materials resides primarily in closed cells. If a blowing agent were to be used in the conventional manner to "puff" or expand the cells, the blowing agent imbibed within the cells would not generate sufficient pressure within the cells because of their open nature. The relatively large volume of aqueous solution employed to treat tobacco stems in accordance with the present invention enters the open cells. When gaseous pressure is generated by the imbibed liquid, this liquid begins to exit the cell, but in so doing forms a momentary seal of the cell opening, thereby enabling the gas to develop sufficient pressure to expand the cell walls. The expulsion of the liquid from the cells is in fact accompanied by an audible popping sound, under certain treating conditions.

The liquid also functions to soften the cell walls so that they will be amenable to expansion. One role of the base is to accelerate the rapid decomposition of $H_2O_2$ with the in situ formation of $O_2$ gas which serves as the blowing agent.

Furthermore, when a polyvalent salt is used in the pretreatment step, it has been noted that the salt forms a durably retained deposit within the solution-treated and extracted tobacco. The amount of salt deposit is such as to increase the ash content of the tobacco by about 2 to 20%. Although not wishing to be bound by theoretical interpretation, it is felt that the deposit, which may be in the form of a metal hydroxide, carbonate or other insoluble species, serves as a stiffening agent and/or coating whereby contiguous wet, soft shreds of tobacco while drying and undergoing some attendant shrinkage are prevented from clumping or interadhering.

EXAMPLE I

Rolled and cut burley stems (120 cuts/inch) having an open cell content comprising 90% of the total pore volume of the material and a moisture content of 27% were treated while confined in a plastic bag with a stream of 6% ozone in dry oxygen. Treatment was continued at a flow rate of 4 standard cubic feet per hour for a duration of 3 minutes per 44 grams of stems (dry weight basis) at room temperature.

The ozone-treated stems were immediately soaked in an aqueous solution containing 2.6% KOH and 10.6% $H_2O_2$, the weight of solution being 9.4 times the dry weight of the stems. During the soaking treatment, the solution was recirculated into renewed contact with the stems and the temperature of the solution was maintained at about 30° C. After 15 minutes of contact time with the solution, the stems were separated therefrom and extractively washed with hot water. Drying of the stem material was accomplished in an air-circulating oven at a temperature of 100° C. The dried material was permitted to absorb an amount of moisture to place it in moisture equilibrium with ambient air at 70% RH. The content of "equilibrium" moisture was 12.9%. The re-equilibrated material was tested for filling power and found to have a cylinder volume of 113 cc/10 g.

By way of comparison, the starting stem material was found to have a cylinder volume of only 43 cc/10 g, and a water-extracted counterpart of the starting material had a cylinder volume of 80 cc/10 g. When the aforementioned peroxide soak and subsequent wash was applied to the same stem starting material, but omitting the ozone pretreatment, it was found that the resultant dried product was clumped and substantially useless.

To further demonstrate that smoking materials having a high cylinder volume produce acceptable cigarettes having less tobacco, the peroxide expanded stem material prepared above, along with the starting material and water extracted counterpart, was separately blended with standard cut filler tobacco blend and made into cigarettes.

The cigarettes fabricated from said blends were made to have the same overall resistance to draw (RTD), namely 5" water. The following test data was obtained and illustrate that the improved tobacco product material made in accordance with the present invention permits fabrication of satisfactory cigarettes with less tobacco material.

| Sample | % of Sample in Blend* | Weight of Cigarettes Grams |
|---|---|---|
| Alkaline Peroxide-Treated Stems | 7 | 0.82 |
| | 10 | 0.81 |
| | 26 | 0.71 |
| Untreated Stems (starting material) | 5 | 1.03 |
| | 13 | 1.05 |
| | 26 | 1.04 |
| Water-Extracted Stems | 10 | 1.03 |
| | 11 | 1.01 |
| | 33 | 1.00 |

*By microscopic analysis of the contents of the fabricated cigarettes.

EXAMPLE II

One pound of uncased, unwashed rolled and cut burley stems having 12% OV was sprayed in a rotating drum with 908 cc of an aqueous solution containing 136 g $MgCl_2.6H_2O$. The material was dried at 50° C. in an air circulating oven, and then immersed for 1.5 hours in two gallons of an aqueous solution containing 4.9% KOH and 12.25% $H_2O_2$.

The treated material was separated from the treatment solution, then thoroughly washed in hot tap water, dried at 50° C. and subjected to a re-shredding on a Fitzmill shredder. The product was sieved to remove fine material having a size below 20 mesh. The expanded product had the following properies:

$CV$=125 cc/10 g; $OV$=16.4%, ash=19.5%

The expanded product was mixed at 18% by weight of the total blend with a conventional tobacco filler devoid of reconstituted tobacco or other types of expanded tobacco. Cigarettes coded A were fabricated using the thus prepared blend, and cellulose acetate filters were attached thereto.

As a control sample, the same conventional blend was utilized, to which there was added water-extracted burley stems at a level calculated to produce an 18% content in the total blend. Cigarettes coded B were prepared as above.

The tobacco rod portion of the cigarette was 64 mm in length and each rod was of equal firmness. The cigarettes had the following characteristics.

| | Rod Weight grams | Rod RTD inches |
|---|---|---|
| Cigarettes Coded A | 0.64 | 1.8 |
| Cigarettes Coded B | 0.81 | 1.8 |

For testing purposes, quantities of both cigarettes were selected for uniform total weight and RTD. The cigarette coded A was found to deliver 2% less TPM and 12% less nicotine per puff than the cigarette coded B.

Both samples were submitted for subjective evaluation. A panel of 45 experienced smokers found no significant differences between the cigarettes coded A and B. In an additional panel test, cigarette A was compared with a cigarette similar to the one coded B but wherein the stems were unextracted. The panel again found no significant differences.

EXAMPLE III

Fifty grams of shredded bright stems were impregnated with 250 ml of an aqueous solution containing 60 grams of $MgCl_2.6H_2O$. A vacuum at 736 mm Hg was used to facilitate impregnation. The excess salt solution was decanted, and the stems were dried in an oven at 100° C. The stems at 12% OV were soaked in a solution containing 80% $NH_4OH$ (27% strength) and 20% $H_2O_2$ (30% strength) for 1.5 hours at ambient temperature. The stems were washed in water at 50° C., and dried in an oven at 100° C. for 3 hours. Following equilibration at 23.9° C. and 60% RH, the stems had a cylinder volume of 99 cc/10 grams and an OV of 14.6%.

EXAMPLE IV

Fifty grams of shredded stems were sprayed with 100 ml of a solution containing 60 grams of $MgCl_2.6H_2O$. Vacuum was used to facilitate impregnation. The stems were dried, soaked in the ammonium hydroxide-hydrogen peroxide solution of Example III, washed and then dried in a manner identical to Example III. Following equilibrium at 23.9° C. and 60% RH, the stems had a cylinder volume of 105 cc/10 grams and an OV of 15.0%.

EXAMPLE V

Three batches of shredded stems were sprayed with a $MgCl_2.6H_2O$ solution according to Example IV except that the vacuum impregnation step was omitted. After drying, the stems were soaked under varying conditions in an ammonium-hydroxide-hydrogen peroxide solution identical to that used in Examples III and IV. Batch A was soaked for 1.5 hours and the peroxide solution was recycled. Batch B was soaked for 1.5 hours and Batch C for 1 hour with no recycling of the peroxide solution. After washing and drying, the stems were equilibrated and the cylinder volume of each batch was measured. The results are tabulated in Table I.

TABLE I

| | CV cc/10 grams | OV (%) |
|---|---|---|
| Batch A | 113 | 14.7 |
| Batch B | 129 | 14.4 |
| Batch C | 120 | 13.8 |

EXAMPLE VI

A series of tests was made in which 50 grams of bright stems per test were soaked in 500 ml of solution containing 60 grams $MgCl_2.6H_2O$ and subjected to vacuum impregnation. The stems were partially dried to 30% OV and individual batches were soaked in solutions of potassium hydroxide-hydrogen peroxide of varying concentrations. The peroxide solution was recycled to ensure uniform treatment of the stems. Contact time for each batch of stems was 2 hours. After draining the excess alkaline-peroxide solution, the partially expanded stems were washed with hot water and dried in an oven at 100° C. for 3 hours. Following equilibration of the dried expanded stems, the cylinder volumes were determined. The results are tabulated in Table II.

TABLE II

| Solution | | | CV | OV |
|---|---|---|---|---|
| Concentration of KOH (%) | Concentration of $H_2O_2$ (%) | Concentration of $H_2O_2$ (%) / Concentration of KOH (%) | Equilibrated cc/10 grams | Equilibrated % |
| 7.5 | 0 | 0 | 78 | 14.5 |
| 6.8 | 3.0 | 0.44 | 130 | 14.9 |
| 6.0 | 6.0 | 1.0 | 147 | 14.5 |
| 5.3 | 9.0 | 1.7 | 151 | 14.6 |
| 4.9 | 10.5 | 2.1 | 143 | 14.0 |
| 4.5 | 12.0 | 2.6 | 155 | 13.8 |
| 4.1 | 13.5 | 3.3 | 161 | 15.2 |
| 3.75 | 15.0 | 4.0 | 162 | 13.7 |
| 3.4 | 16.5 | 4.8 | 155 | 14.7 |
| 3.0 | 18.0 | 6.0 | 157 | 13.4 |
| 2.3 | 21.0 | 9.1 | 149 | 13.9 |
| 0 | 9.0 | ∞ | 85 | 12.5 |

EXAMPLE VII

In a similar manner to Example VI, a series of tests was made to determine the optimum ratio of $NH_4OH$:-$H_2O_2$ for tobacco stem expansion. Ambient temperatures were employed during alkaline-peroxide treatment with the exception of two tests wherein the solution was cooled to 5° C. during contact with the stems. Following equilibration of the expanded stems, the cylinder volume was measured. The results are tabulated in Table III.

TABLE III

| Solution | | | | CV | OV |
|---|---|---|---|---|---|
| Concentration of $NH_4OH$ (%) | Concentration of $H_2O_2$ (%) | Concentration of $H_2O_2$ (%) / Concentration of $NH_4OH$ (%) | Temperature of Reaction | Equilibrated cc/10 grams | Equilibrated % |
| 21.6 | 6 | .27 | Ambient | 105 | 15.0 |
| 18.9 | 9 | .47 | Ambient | 114 | 14.7 |
| 17.5 | 10.5 | .60 | Ambient | 127 | 14.5 |
| 16.2 | 12 | .74 | Ambient | 117 | 14.2 |
| 13.5 | 15 | 1.11 | Ambient | 111 | 13.7 |
| 10.8 | 18 | 1.66 | Ambient | 108 | 13.4 |
| 10.8 | 18 | 1.66 | Cooled | 115 | 13.6 |
| 8.1 | 21 | 2.59 | Cooled | 105 | 13.3 |

EXAMPLE VIII

Reconstituted base web prepared by conventional methods wherein the tobacco materials are extracted with water and the thus formed extract is separated from the fibrous residue. The residue was then formed into a base web and moisturized with steam to a level of about 35% OV. The web was shredded on a paper shredder and the shreds were subjected to ozone treatment at ambient temperature while confined in a polyethylene bag. Exposure to ozone was continued until the shreds developed a slightly lighter color. The shreds were then spread on a tray and sprayed with a 65/35 mixture of $NH_4OH$ (30%) and $H_2O_2$ (35%). About 50 ml of the solution was utilized per 30 grams of shreds (dry weight basis). The material was then dried at 45° C. and re-equilibrated to normal moisture regain. The cylinder volume and OV data obtained on this material, and on related control samples are tabulated in Table IV.

TABLE IV

| Sample | CV cc/10 grams | OV % |
|---|---|---|
| 1. As per Example VIII | 112 | 14 |
| 2. Starting shreds-no treatment | 90 | 14 |
| 3. Treatment only with $O_3$ | 91 | 14 |

TABLE IV-continued

| Sample | CV cc/10 grams | OV % |
|---|---|---|
| 4. Omitting $O_3$, just $NH_4OH/H_2O_2$ | 97 | 14 |

EXAMPLE IX

Rolled and cut unwashed burley stems were immersed in a saturated aqueous solution of $CaCl_2$ at 90° C. The mixture was placed in a vacuum chamber which removed air from the stems, thereby facilitating more efficient impregnation of the $CaCl_2$ solution. Excess solution was drained off.

The treated stems were dried at 80° C. The dry, salt-impregnated product was then immersed in a solution comprising 85 parts of 29% $NH_4OH$ solution, and 15 parts of 30% $H_2O_2$ solution, and maintained at room temperature. After 30 minutes of immersion, during which visible expansion occured, the stems were washed in hot tap water to remove excess $NH_4OH$ and $H_2O_2$, and the washed product was dried at 60° C. in an air-circulating oven.

The resultant product was found to have an equilibrated OV of 10.9%, a cylinder volume of 93 cc/10 grams, and an ash content of about 40%. By correcting the cylinder volume for the weight of non-combustible ash and water, a value of 17 cc of filling volume per gram of combustible material was obtained.

When blended with cut tobacco and made into cigarettes, an acceptable quality smoke was produced having less harshness and spiciness than the original burley stems.

EXAMPLE X

The experiment of Example IX was repeated using $MgCl_2$ instead of $CaCl_2$. The resultant product contained 25% ash and 16.1% equilibrated OV. The cylinder volume was 98 cc/10 grams which, after correcting for non-combustible material, was 17 cc of filling volume per gram of combustible material.

The material was blended at the 15% level with a conventional type tobacco filler and made into handmade cigarettes. The smoking qualities were adjudged to be milder than the control containing no expanded tobacco. No adverse flavor effects were noted.

EXAMPLE XI

In a series of tests, 50-gram batches of rolled and cut barley tobacco stems at 12% OV were sprayed with a solution containing $MgCl_2.6H_2O$ so as to incorporate various amounts of magnesium chloride into the stems. After the salt-impregnated stems were dried to 15% OV, they were contacted with a solution of either $NH_4OH$—$H_2O_2$ or KOH—$H_2O_2$ for 2 hours with recycling of the alkaline-peroxide solution at ambient temperature. The partially expanded stems were dried in an air circulating oven at 100° C. for 2 hours and equilibrated under controlled conditions. The cylinder volume was measured to determine the optimum level of salt impregnation. The results are tabulated in Table V.

TABLE V

| Grams of $MgCl_2.6H_2O$ per 50 Grams of Stems (DWB*) | Base Used | Solution Base Concentration % | Solution $H_2O_2$ Concentration % | CV Equilibrated cc/10 grams | OV Equilibrated % |
|---|---|---|---|---|---|
| 60 | $NH_4OH$ | 17.5 | 10.5 | 127 | 14.5 |
| 45 | $NH_4OH$ | 17.5 | 10.5 | 125 | 14.6 |
| 30 | $NH_4OH$ | 17.5 | 10.5 | 132 | 16.0 |
| 15 | $NH_4OH$ | 17.5 | 10.5 | 132 | 14.8 |
| 15 | $NH_4OH$ | 13.5 | 15.0 | 136 | 14.5 |
| 80 | KOH | 4.8 | 10.5 | 145 | 14.4 |
| 60 | KOH | 4.8 | 10.5 | 143 | 14.0 |
| 45 | KOH | 4.8 | 10.5 | 154 | 13.7 |
| 30 | KOH | 4.8 | 10.5 | 143 | 14.0 |
| 14 | KOH | 4.8 | 10.5 | 142 | 14.5 |

*DWB = dry weight basis

What is claimed is:

1. A process for expanding tobacco comprising the steps of:
   (a) contacting rolled and cut tobacco stems having a moisture content between about 2 and 40% OV with an aqueous solution of a polyvalent salt in an effective amount to prevent clumping and interadherence thereof during subsequent processing;
   (b) partially drying the salt treated stems to a moisture content between about 10 and 40% OV;
   (c) contacting the stems with an alkaline-hydrogen peroxide solution at a temperature below about 55° C. and for a period of time between 5 minutes and 3 hours to effect expansion thereof;
   (d) extracting the expanded stems with water to remove water-soluble substances; and
   (e) drying the expanded, extracted stems at a temperature between about 50° C. and 200° C. to obtain a final moisture content between about 10 to 15%.

2. The process of claim 1 wherein the stems are extracted with water prior to the salt treatment of Step (a).

3. The process of claim 1 wherein the stems are cut to about 75 to 200 cuts per inch prior to the salt treatment of Step (a).

4. The process of claim 1 wherein the contacting of Step (a) comprises impregnating into tobacco stems a polyvalent salt solution in an amount sufficient to incorporate between about 15 and 80 grams of said polyvalent salt per 50 grams of stems.

5. The process of claim 4 which comprises impregnating the stems by soaking, dipping or spraying.

6. The process of claim 5 wherein a vacuum is utilized to effect impregnation of the stems with said polyvalent salt solution.

7. The process of claim 4 wherein the polyvalent salt is selected from the group consisting of the chloride, acetate or nitrate of metals selected from calcium, magnesium, zinc and aluminum.

8. The process of claim 7 wherein the salt is magnesium chloride.

9. The process of claim 7 wherein the salt is a calcium salt.

10. The process of claim 1 wherein the salt solution is recirculated through the stems to effect substantially total impregnation.

11. The process of claim 1 wherein the alkaline-hydrogen peroxide solution is recirculated through the stems to effect uniform treatment thereof.

12. The process of claim 1 wherein the alkaline-hydrogen peroxide solution contains a base at a concentration between about 2 and 20%, said base being selected from the group consisting of the hydroxide of ammonium, potassium, sodium and calcium or the carbonate of sodium and potassium.

13. The process of claim 12 wherein the pH of the alkaline-hydrogen peroxide solution is between about 8 and 10.

14. The process of claim 1 wherein the stems are contacted with at least 65% by weight of the alkaline-hydrogen peroxide solution by means of spraying or immersion.

15. The process of claim 12 wherein the alkaline-hydrogen peroxide solution comprises ammonium hydroxide and hydrogen peroxide, wheren the ratio of hydrogen peroxide to ammonium hydroxide is between about 0.2 and 2.6.

16. The process of claim 12 wherein the alkaline-hydrogen peroxide solution comprises potassium hydroxide and hydrogen peroxide wherein the ratio of hydrogen peroxide to potassium hydroxide is between 1 and 9.

17. The process of claim 16 wherein the pH of alkaline-hydrogen peroxide solution is between about 9 and 10.

18. The process of claim 1 wherein the dried stems of Step (d) are subjected to a roasting operation at a temperature between about 175° and 300° C. for a period of time of from about 5 to 50 minutes to effect a weight loss between 5 and 15% to obtain a rich brown tobacco-like colored, expanded product.

19. The process of claim 1 wherein propylene glycol is added to the washed stems of Step (d) at a level between about 10 to 20% by weight of the stems prior to drying.

20. The process of claim 1 wherein the solubles removed during extraction are treated to remove the nitrate salts therefrom and the denitrated solubles are reapplied to the stems prior to drying.

21. The expanded tobacco product prepared according to the process of claim 1.

22. A smoking article containing expanded tobacco prepared according to the process of claim 1.

23. The smoking article of claim 22 wherein the expanded tobacco comprises from about 1 to 50% by weight of the total blend.

* * * * *

UNITED STATES PATENT AND TRADEMARK OFFICE

CERTIFICATE OF CORRECTION

PATENT NO. : 4,366,823

DATED : January 4, 1983

INVENTOR(S) : Norman B. Rainer et al.

It is certified that error appears in the above-identified patent and that said Letters Patent is hereby corrected as shown below:

Column 14, line 44, Claim 17, "claim 16" should read -- claims 15 or 16 --.

Signed and Sealed this

*Seventh* Day of *May 1985*

[SEAL]

*Attest:*

DONALD J. QUIGG

*Attesting Officer*

*Acting Commissioner of Patents and Trademarks*